United States Patent [19]

Hildebrand et al.

[11] 4,129,841

[45] Dec. 12, 1978

[54] RADIATING CABLE HAVING SPACED RADIATING SLEEVES

[75] Inventors: Helmut Hildebrand, Langenhagen; Gerhard Dunker, Hanover, both of Fed. Rep. of Germany

[73] Assignee: Kabel-und Metallwerke Gutehoffnungshutte A.G., Hanover, Fed. Rep. of Germany

[21] Appl. No.: 824,427

[22] Filed: Aug. 15, 1977

[30] Foreign Application Priority Data

Aug. 13, 1976 [DE] Fed. Rep. of Germany ..... 2636523

[51] Int. Cl.[2] ..... H01P 3/06

[52] U.S. Cl. ..... 333/84 L; 343/771

[58] Field of Search ..... 333/84 L; 343/770, 771; 179/82

[56] References Cited

U.S. PATENT DOCUMENTS

| | | | |
|---|---|---|---|
| 3,963,999 | 6/1976 | Nakajima et al. | 333/84 L |
| 4,053,835 | 10/1977 | Breitenbach | 333/84 L |

*Primary Examiner*—Paul L. Gensler

*Attorney, Agent, or Firm*—Smyth, Pavitt, Siegemund, Jones & Martella

[57] ABSTRACT

A regular, radiating coaxial transmission line is improved by covering it with an insulating coating; similar, cylindrical, radiating elements are equidistantly placed on the line and at a center-to-center distance equal to the wavelength of the center frequency of the h.f. band as transmitted in and through the line.

6 Claims, 2 Drawing Figures

FIG. 1
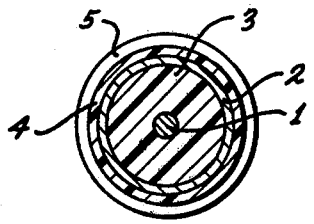
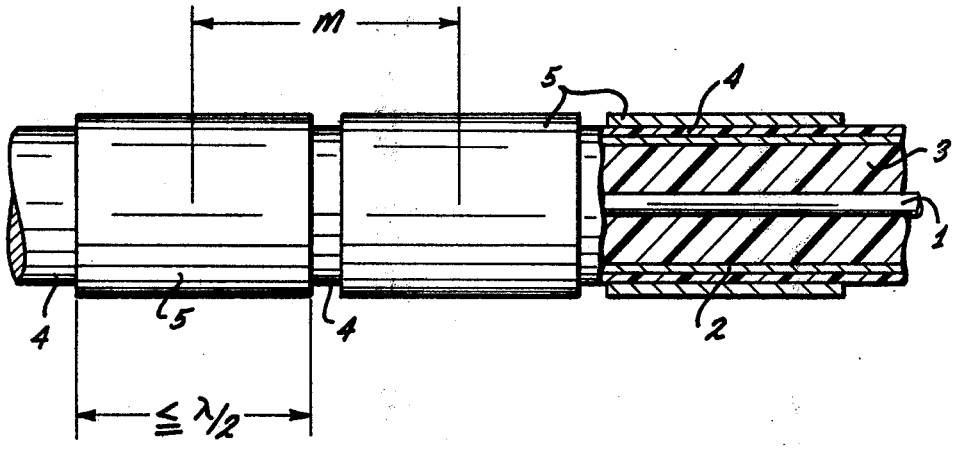
FIG. 2

RADIATING CABLE HAVING SPACED RADIATING SLEEVES

BACKGROUND OF THE INVENTION

The present invention relates to a coaxial transmission line or cable radiating as well as transmitting electromagnetic high frequency energy. Such a cable is comprised of an inner conductor, an outer conductor disposed in concentric relation to the inner conductor and a dielectric spacer between the two conductors, the outer conductor being constructed so that the cable transmits as well as radiates h.f. energy, thus acting as a regular transmission line as well as an antenna.

The concentric conductor system of a coaxial cable will or will not radiate high frequency energy, depending essentially on the configuration of the outer conductor. Of course, all transmission lines have radiation losses to some extent, which are minimized as much as possble for regular coaxial cable. In some instances, however, it is desirable to have the cable acting as an antenna radiating a particular portion of the transmitted power over its entire or a well defined extension. Cables radiating high frequency are used to transmit radio frequencies to a mobile receiver. For example, such cables are used inside railway tunnels to insure the transmission of signals to a train while passing through the tunnel. It is, of course, required that such a cable radiates as uniformly as possible over its extension while that portion of energy which is not being transmitted by such radiation be transmitted through the cable at a low loss.

Radiating cable of this type are, for example, installed along railway tracks where the cable is particularly mounted to the ties or on poles placed alongside the track. In the case of a tunnel, the cable may be affixed to and along the wall of the tunnel. The conventional radiating cables are, for example, constructed as unshielded symmetrical conductors. However, such a radiating cable is directly exposed to the environment and to weather conditions so that the losses, as well as the transmission characteristics, vary greatly. This is particularly true if such a cable is affixed directly to the ground.

The German printed patent appliction No. 1,044,199 discloses a high fequency radiating cable which is basically of coaxial configuration, but the outer conductor is provided with a longitudinal gap or slot which runs parallel to the axis of the cable. The outer conductor, therefore, is an incomplete tube enveloping only partially the insulation surrounding the inner conductors. High-frequency energy is radiated through the slot or gap.

The German printed patent application No. 2,022,990 discloses a high-frequency cable in which the outer conductor is constructed by winding a ribbon or a wire-like material around the dielectric spacer on the inner conductor. High frequency energy radiates through the resulting gaps or openings. Either of these radiating cables exhibits the drawback that in the case of continuous transmission standing waves are set up along the outer conductor, thus, producing strong variations in the strength of the outer electric field in longitudinal direction of the cable. Consequently, the radiated signals are received under conditions of significant inerference.

The printed German patent application No. 1,690,138 discloses a cable constructed for discontinuous operation. This cable has again a tubular outer conductor which is provided with a slot from which emerges an electromagnetic field. The slot extends obliquely to the axis of the cable but its direction changes, resulting in a zig-zag line. Metal rings short-circuit the slot wherever it changes direction. The purpose of this particular configuration of the slot is to suppress the axial component of the electromagnetic field so that it will not be radiated and, ultimately, an attempt is made here to establish a more uniform field. It was found, however, that in practice this hoped-for effect does not occur or it occurs only to a very significant extent. Moreover, such a cable is very difficult to manufacture because different kinds of cable, particularly different dimensions thereof, require different configurations of the respective slot. Hence, the stamping tools making this slot will differ. Also, the short-circuiting metal rings must be individually placed on the cable; such a procedure precludes a continuous production.

DESCRIPTION OF THE INVENTION

It is an object of the present invention to provide a new and improved radiating, high-frequency coaxial transmission line and cable which avoids the formation of standing waves, exhibits uniform distribution of the outer field over the entire extension of the cable, and can be made in a rather simple manner under utilization of conventional cable-making equipment.

In accordance with the preferred embodiment of the present invention, it is suggested to provide a regular, radiating high-frequency cable which is composed of an inner conductor, a dielectric spacer, and an outer conductor which is constructed so as to obtain radiation from the cable. The outer conductor is completely enveloped in insulating material, and individual, electrically conductive, radiating elements, preferably copper sleeves, are arranged on the cable in spaced apart relation to each other. Each of the elements has an axial length equal to or less than half the wavelength of the center frequency of the h.f. signal band as radiated from the cable, while the center to center distance of adjusting radiating elements is equal to a full wavelength of the h.f. center frequency propagating through the interior of the cable.

It can thus be seen that the new h.f. cable can be constructed on the basis of a conventional, concentric and coaxial cable of the radiating variety, having any of the configurations outlined in the introduction. Such a cable is improved in an unobvious manner by covering it with a thin insulating layer and by placing particularly dimensioned and spaced radiating elements on that layer and along the cable. The particular center-to-center spacing ensures that each element radiates at a 360° phase shift with respect to either of the respective two adjacent elements, so that they all radiate in synchronism. Since the propagation speeds of the h.f. waves differ in the inside and on the outside of the cable, the elements are still sufficiently spaced even if their individual length is equal to half a wavelength, based on the external speed of propogation for such waves.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 illustrates the cross section through a radiating high frequency conductor in accordance with the preferred embodiment of the invention; and FIG. 2 is partially a side view, partially a longitudinal section view of the cable as shown in FIG. 1.

Proceeding now to the detailed description of the drawings, FIG. 1 illustrates a coaxial conductor system which includes an inner conductor 1 being surrounded concentrically by a tubular outer conductor 2. The space between the conductors 1 and 2 is filled (at least partially) with a dielectric material 3 which also serves as a spacer for the two conductors. It should be realized that details of the conductor and their configuration as well as the configuration of the spacer and the nature of the dielectric material is of secondary importance for the present invention. The decisive aspect is that the cable is constructed so that high frequency energy radiates therefrom.

The inner conductor 1 may, for example, be comprised of a copper wire or of a copper tube. The dielectric insulation 3 may be of solid material, but it is preferred for reasons of weight that the insulation be a foamed polymer or the like. Alternatively, the interior space between the two conductors 1 and 2 is not necessarily filled with solid or foam material but the dielectric spacer may be comprised of individual discs, arms, a helical coil or the like.

The outer conductor 2 is of conventional construction as far as a radiating cable is concerned. That is to say, conductor 2 may be constructed as a tube having a longitudinal slot. Alternatively, a metal ribbon or wire may have been wrapped around the spacer 3 establishing radiating gaps. Of course, the spacer 3 must be constructed in this case to establish adequate support for the flexible material of which the outer conductor is made.

The outer conductor 2 is covered by a layer or envelope of a conventional insulative material, for example, a polyethelene. The insulating envelope 4 has two functions. First of all, it insulates the outer conductor with respect to the environment. In addition, layer 4 establishes a supporting surface for radiating elements 5.

Elements 5 are, for example, constructed as sleeves which are individually placed and distributed along the extension of the cable but in spaced apart relation to each other. The configuration of the radiators 5 depends on the dimensions of the particular cable and it depends further on the band width of the h.f. energy to be radiated and transmitted. As shown, the sleeves 5 are of complete cylindrical configuration, that is to say, they do not have any axial gap. However, they each may have an axial gap; as a general rule, the sleeves should have azimuthal dimensions for at least partially enclosing the cable. However, complete enclosure by tubular configuration is preferred.

The radiators 5 are made either of conductive or of partially conductive material. By way of example, the sleeves 5 may be made of copper or of aluminum. If partial conduction is desired and sufficient, the sleeves could be made of a suitable plastic, usually a polymer which has been rendered conductive through the addition of soot, carbon black or graphite.

Each radiator 5 has preferably a length equal to half the wavelength of the center frequency of the transmission band to be radiated. This half wavelength dimension is deemed to be the maximum value, although a sligthly smaller axial length of the radiators still suffices. Upon calculating the length, one could obtain slightly smaller values on account of the differences in propagation velocity of the h.f. energy inside and outside of the cable. It is decisive and essential that two adjacent radiators 5 do not engage each other but are spaced apart by at least a small but still noticeable axial gap. The center-to-center distance M of two adjacent radiators 5 in axial direction is determined by the requirement that the individual radiators should radiate in phase synchronism. That distance, therefore, should be equivalent to a 360° phase shift commensurate with the transmission and propagation of h.f. waves in the interior of the cable.

It should be realized that the h.f. energy has a slower speed inside of the cable than on the outside so that the wavelength of the h.f. energy, particularly the wavelength of the center frequency of the transmission band as transmitted in the cable, is smaller on the inside than the corresponding wave-length of the h.f. energy as radiated on the outside. Therefore, the gap between two adjacent radiators 5 has an axial width which is significantly less than half the wavelength of the center frequency as radiated. This is particularly true if each radiator has a length equal to or less than half the wavelength.

The arrangement as illustrated establishes a radiating cable in which the relatively dense distribution of radiators in axial direction is effective as a line of dipoles and produces a uniform field distribution.

The invention is not limited to the embodiments described above but all changes and modifications thereof not constituting departures from the spirit and scope of the invention are intended to be included.

We claim:

1. Radiating high frequency cable having an inner conductor, an outer conductor and a spacer made of dielectric material disposed and configured so as to establish a concentric relation between the inner and the outer conductors, the outer conductor being constructed to radiate high frequency energy as transmitted through the cable, the improvement comprising:

an insulative envelope on the outer conductor; and a plurality of radiating elements made of electrically conductive material and placed on the envelope in axially spaced apart relation to each other, each of the elements having an axial length not larger than half the wavelength of the radiated energy at a particular frequency of a radiated band, the elements having an axial center-to-center distance equal to the wavelength of the energy at said frequency and as transmitted through the cable.

2. The improvement as in claim 1, said elements being sleeves being made of metal.

3. The improvement as in claim 2, said metal being copper.

4. The improvement as in claim 1, said elements being made of a non-metallic conductive material.

5. The improvement as in claim 1, said elements being sleeves.

6. The improvement as in claim 5, said sleeves enclosing the cable circumferentially.

* * * * *